US011585040B2

(12) United States Patent
Xu et al.

(10) Patent No.: US 11,585,040 B2
(45) Date of Patent: Feb. 21, 2023

(54) WASHING MACHINE ASSEMBLY

(71) Applicant: TCL HOME APPLIANCES (HEFEI) CO., LTD, Anhui (CN)

(72) Inventors: Wengen Xu, Anhui (CN); Benyang Bian, Anhui (CN); Wenjie Zhang, Anhui (CN); Huan Qi, Anhui (CN)

(73) Assignee: TCL Home Appliances (Hefei) Co., Ltd., Hefei (CN)

( * ) Notice: Subject to any disclaimer, the term of this patent is extended or adjusted under 35 U.S.C. 154(b) by 170 days.

(21) Appl. No.: 17/267,276

(22) PCT Filed: Nov. 5, 2019

(86) PCT No.: PCT/CN2019/115673
§ 371 (c)(1),
(2) Date: Feb. 9, 2021

(87) PCT Pub. No.: WO2020/143289
PCT Pub. Date: Jul. 16, 2020

(65) Prior Publication Data

US 2021/0310178 A1 Oct. 7, 2021

(30) Foreign Application Priority Data

Jan. 9, 2019 (CN) ..... 201910020856.8

(51) Int. Cl.
*D06F 39/14* (2006.01)
*D06F 19/00* (2006.01)
(Continued)

(52) U.S. Cl.
CPC ..... *D06F 39/14* (2013.01); *D06F 19/00* (2013.01); *D06F 31/00* (2013.01); *D06F 37/20* (2013.01); *D06F 37/26* (2013.01); *D06F 37/30* (2013.01)

(58) Field of Classification Search
CPC ..... D06F 39/14; D06F 19/00; D06F 31/00; D06F 37/20; D06F 37/26; D06F 37/30
(Continued)

(56) References Cited

U.S. PATENT DOCUMENTS 10,480,111 B2 11/2019 Song et al.
2011/0120195 A1* 5/2011 Jeoung ..... D06F 37/28 68/139

(Continued)

FOREIGN PATENT DOCUMENTS

CN 201567472 U 9/2010
CN 104790166 A 7/2015

(Continued)

OTHER PUBLICATIONS

1st Office Action dated Feb. 8, 2022, for TCL Home Appliances (Hefei) Co., Ltd., Japan Application No. 2021-525361 filed on Nov. 5, 2019.

(Continued)

*Primary Examiner* — Tinsae B Ayalew
(74) *Attorney, Agent, or Firm* — Nathan & Associates; Menachem Nathan

(57) ABSTRACT

The present application relates to washing machine assembly. The described washing machine assembly comprises a body, an outer drum, an inner drum, a door assembly and an ultrasound apparatus; the outer drum is connected to the body, and an accommodating container and an open groove that communicate with each other are formed inside of the outer drum; the inner drum is located inside of the accommodating container and a washing tank is formed in the inner drum; the door assembly is rotatingly connected on the outer drum, the door assembly covers the outer drum so as to block the open groove, and an mounting hole is formed inside of the door assembly; the ultrasound apparatus is
(Continued)

located inside of the mounting hole and is connected to the door assembly, and the ultrasound apparatus is at least partially located inside of the washing tank.

17 Claims, 13 Drawing Sheets

(51) Int. Cl.

| | |
|---|---|
| ***D06F 31/00*** | (2006.01) |
| ***D06F 37/20*** | (2006.01) |
| ***D06F 37/26*** | (2006.01) |
| ***D06F 37/30*** | (2020.01) |

(58) Field of Classification Search
USPC ..... 68/12.24
See application file for complete search history.

(56) References Cited

U.S. PATENT DOCUMENTS

| | | | | |
|---|---|---|---|---|
| 2013/0233030 | A1 | 9/2013 | Chindyasov | |
| 2015/0204001 | A1* | 7/2015 | Song | D06F 35/002 8/137 |

FOREIGN PATENT DOCUMENTS

| | | | |
|---|---|---|---|
| CN | 205814277 | U | 12/2016 |
| CN | 106868772 | A | 6/2017 |
| CN | 206941235 | U | 1/2018 |
| CN | 208121401 | U | 11/2018 |
| CN | 109518401 | A | 3/2019 |
| CN | 109537235 | A | 3/2019 |
| EP | 0261363 | A1 | 3/1988 |
| EP | 2899306 | A2 | 7/2015 |
| GB | 2468158 | A | 9/2010 |
| JP | S6411595 | A | 1/1989 |
| JP | 10-151296 | A | 6/1998 |
| JP | 2001190885 | A | 7/2001 |
| KR | 20040009399 | A | 1/2004 |
| KR | 1020040009399 | A | 1/2004 |
| WO | 2015097634 | A1 | 7/2015 |

OTHER PUBLICATIONS

The Extended European search report dated Jan. 24, 2022 for TCL Home Appliances (Hefei) Co., Ltd., European Application No. 19909499.6.

International Search Report from International Application No. PCT/CN2019/115673 dated Feb. 18, 2020.

* cited by examiner

WASHING MACHINE ASSEMBLY

CROSS REFERENCE TO RELATED APPLICATION

This application is U.S. National Stage of PCT International Application No. PCT/CN2019/115673 filed on Nov. 5, 2019, which claims priority to Chinese Patent Application No. 201910020856.8, filed on Jan. 9, 2019, entitled "WASHING MACHINE ASSEMBLY", the entire content of each of which is incorporated herein in its entirety.

TECHNICAL FIELD

The present disclosure relates to a technical field of household appliances, and in particular, to a washing machine assembly.

BACKGROUND

Washing machines are mainly divided into pulsator washing machines and drum washing machines. For the drum washing machine, its cleaning function is to rely on a mechanical friction effect and a chemical effect of a detergent to wash clothes. The mechanical friction effect includes friction effects between an inner drum of the washing machine and the clothes, and between the clothes. Due to structural advantages of the drum washing machine, the drum washing machine can drive the clothes to move from a low place to a high place, enabling the clothes to be beaten up and down. In addition, the drum washing machine has a heating function, which further enhances the chemical effect of the detergent.

Although the mechanical friction effect of the drum washing machine can improve the washing effect of the clothes, it will cause the clothes to wear and tangle, especially when washing long clothes, such as pants or bath towels, resulting in a damage to the clothes and a poor ease of use. Although the drum washing machine has the heating function, that is, increasing a water temperature to accelerate the chemical effect of the detergent, an increasing rate of the water temperature is slower, resulting in longer washing time and higher energy consumption.

In a conventional ultrasonic washing machine, an ultrasonic device is mounted on an outer drum of the washing machine. During use, ultrasonic waves of the ultrasonic washing machine are blocked by an outer wall of an inner drum when being transmitted to the inner drum, such that less ultrasonic waves enter the inner drum. That is, the ultrasonic waves have a poor effect on the clothes in the inner drum, such that the ultrasonic washing machine only has a cleaning effect between the inner drum and the outer drum, but has no effect on laundry, resulting in poor cleaning effect of the ultrasonic washing machine.

In addition, the conventional washing machine, whether it is the pulsator washing machine or the drum washing machine, are prone to having problems of inadequate dissolution of the detergent and the detergent being concentrated adhesion to a partial surface of the clothes, when utilizing the chemical effect of the detergent, resulting in poor washing effect of the clothes and greater waste of the detergent.

SUMMARY

According to various embodiments of the present disclosure, a washing machine assembly is provided.

A washing machine assembly includes:

a body;

an outer drum connected to the body, the outer drum forming a receiving cavity and an opening groove in communication with receiving cavity therein;

an inner drum located in the receiving cavity, the inner drum forming a washing tank;

a door assembly rotatably connected to the outer drum, the door assembly covering the outer drum to block the opening groove, and the door assembly forming a mounting hole in communication with the washing tank therein; and an ultrasonic device located in the mounting hole and connected to the door assembly, and the ultrasonic device being at least partially located in the washing tank.

Details of one or more embodiments of the present application are set forth in the following drawings and description. Other features, objects and advantages of the present application will be apparent from the description, drawings, and claims.

BRIEF DESCRIPTION OF THE DRAWINGS

In order to better describe and illustrate embodiments and/or examples of those applications disclosed herein, a reference may be made to one or more drawings. The additional details or examples used to describe the drawings should not be considered as limiting the scope of any one of the disclosed applications, the currently described embodiments and/or examples, and the best mode of these applications currently understood.

DETAILED DESCRIPTION OF THE EMBODIMENTS

In order to facilitate the understanding of the present disclosure, the present disclosure will be described more fully with reference to the relevant drawings. Preferred embodiments of the present disclosure are shown in the attached drawings. However, the present disclosure can be implemented in many different forms and is not limited to the embodiments described herein. On the contrary, providing these embodiments is to make the disclosure of the present disclosure more thorough and comprehensive.

It should be noted that when an element is referred to as being "fixed to" another element, it can be directly on another element or there may be an intermediate element therebetween. When an element is considered to be "connected to" another element, it can be directly connected to another element or there may be an intermediate element at the same time.

Unless otherwise defined, all technological and scientific terms used herein have the same meaning as commonly understood by those skilled in the technical field to which the present disclosure belongs. The terms used in the specification of the present disclosure herein are only for the purpose of describing specific embodiments, and are not intended to limit the present disclosure.

In an embodiment, a washing machine assembly includes a body, an outer drum, an inner drum, a door assembly, and an ultrasonic device. The outer drum is connected to the body. A receiving cavity and an opening groove in communication with receiving cavity are formed in the outer drum. The inner drum is located in the receiving cavity. A washing tank is formed in the inner drum. The door assembly is rotatably connected to the outer drum. The door assembly covers the outer drum to block the opening groove. A mounting hole is formed in the door assembly. The ultrasonic device is located in the mounting hole and connected to the door assembly. The ultrasonic device is at least partially located in the washing tank.

Figure 1:
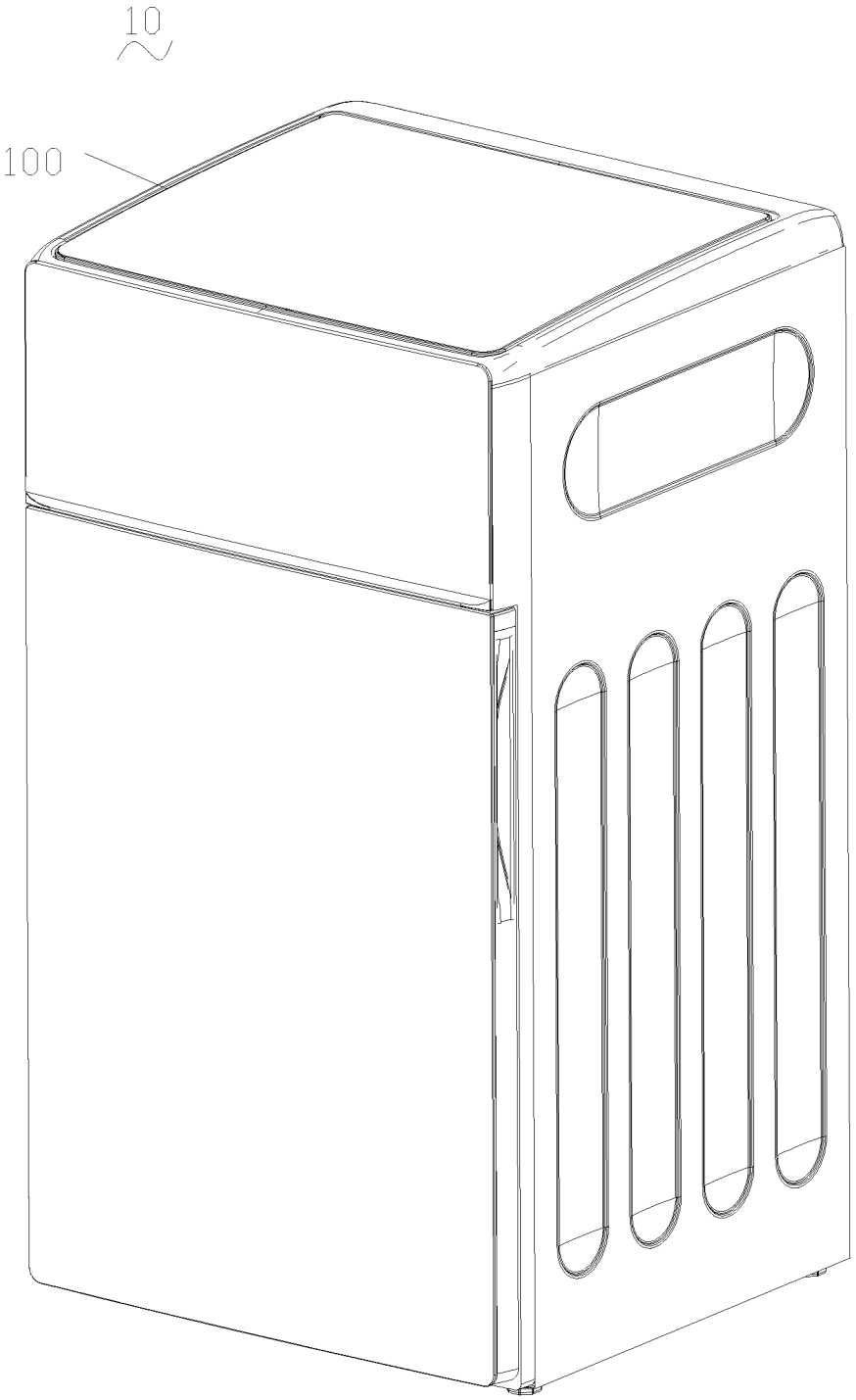
FIG. 1 is a schematic view of a washing machine assembly according to an embodiment.
Figure 2:
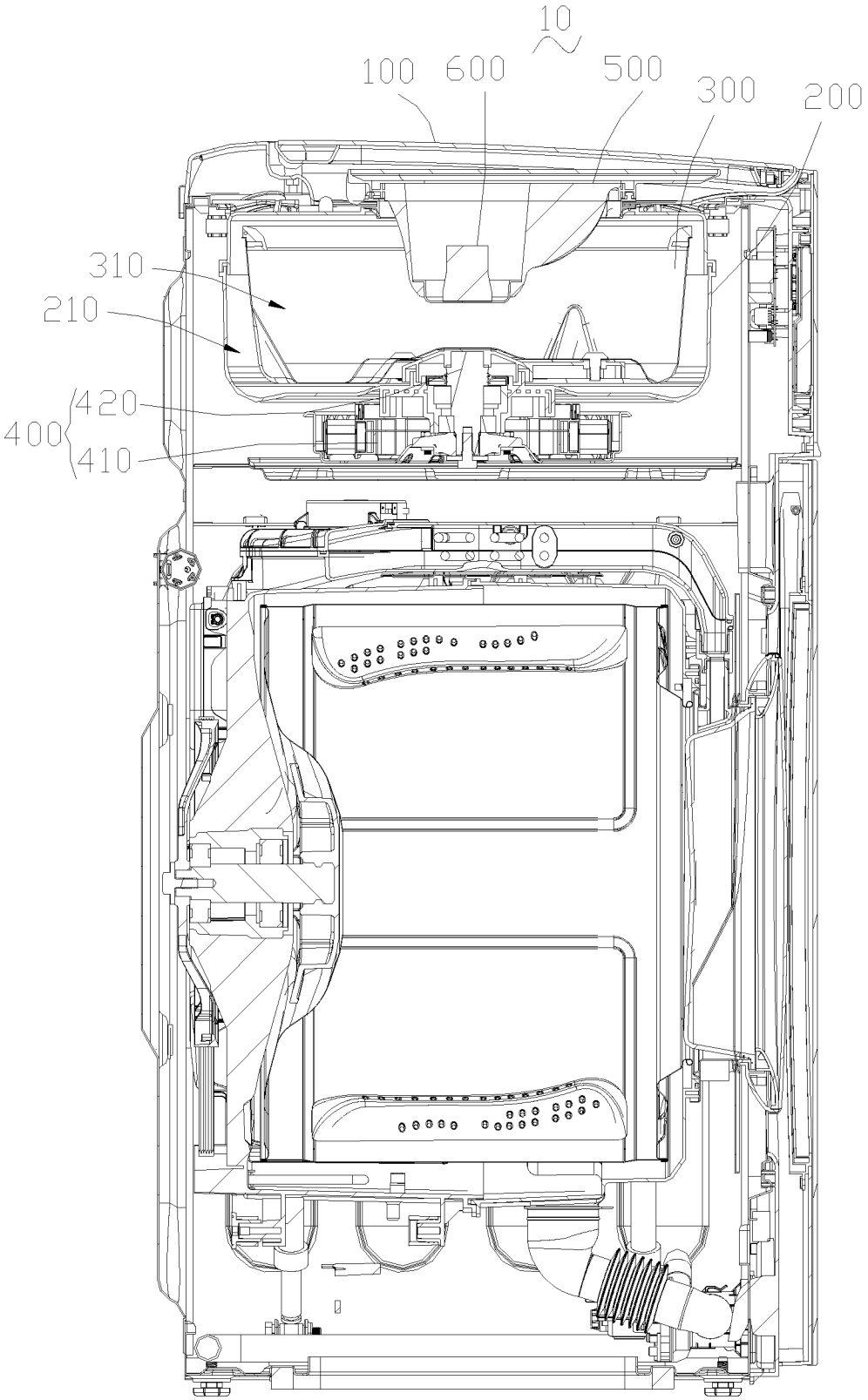
FIG. 2 is a cross-sectional view of the washing machine assembly shown in FIG. 1.

As shown in FIGS. 1 and 2, a washing machine assembly 10 according to an embodiment includes a body 100, an outer drum 200, an inner drum 300, a door assembly 500, and an ultrasonic device 600.

Figure 3:
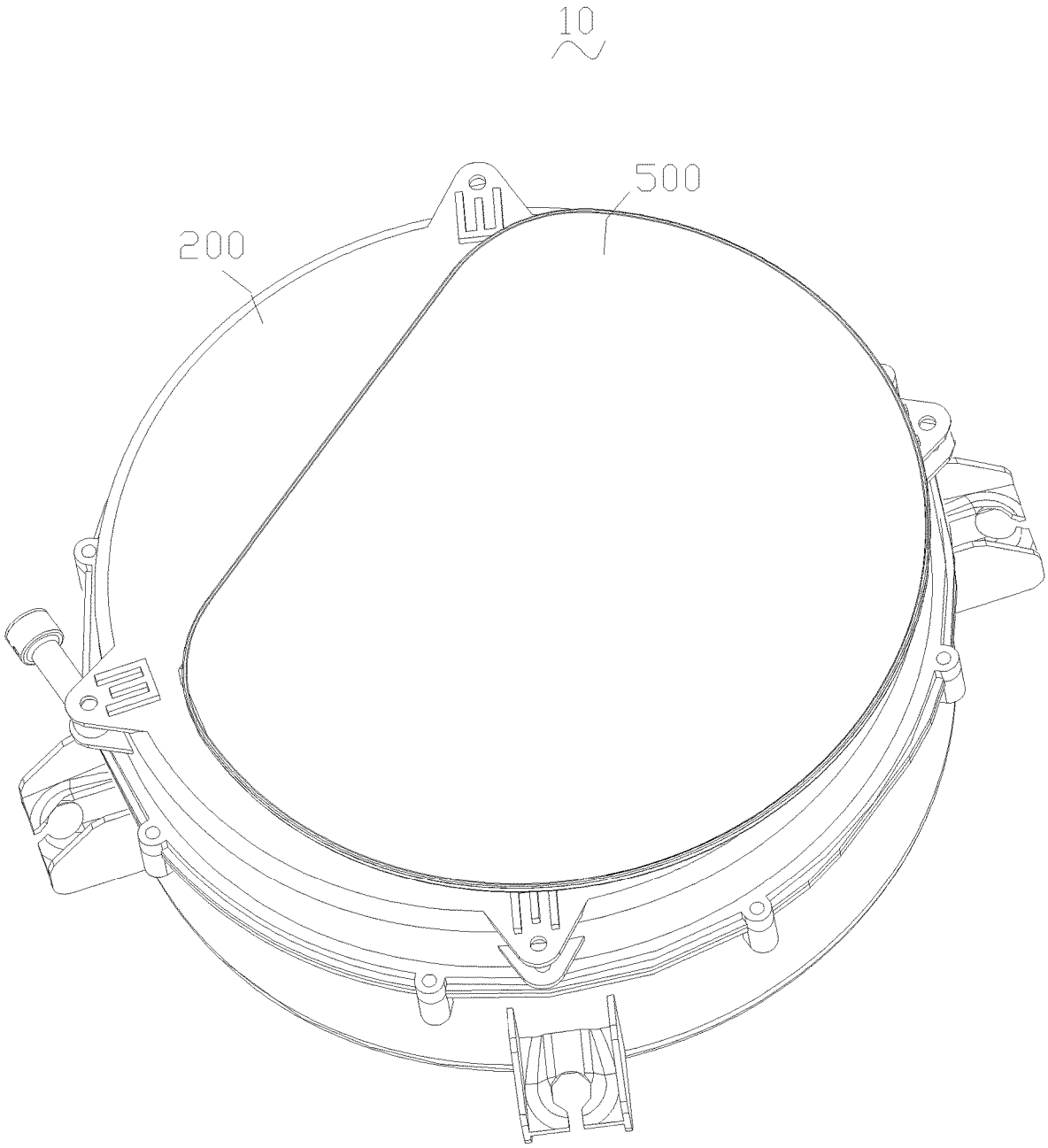
FIG. 3 is a partial schematic view of the washing machine assembly shown in FIG. 1.
Figure 4:
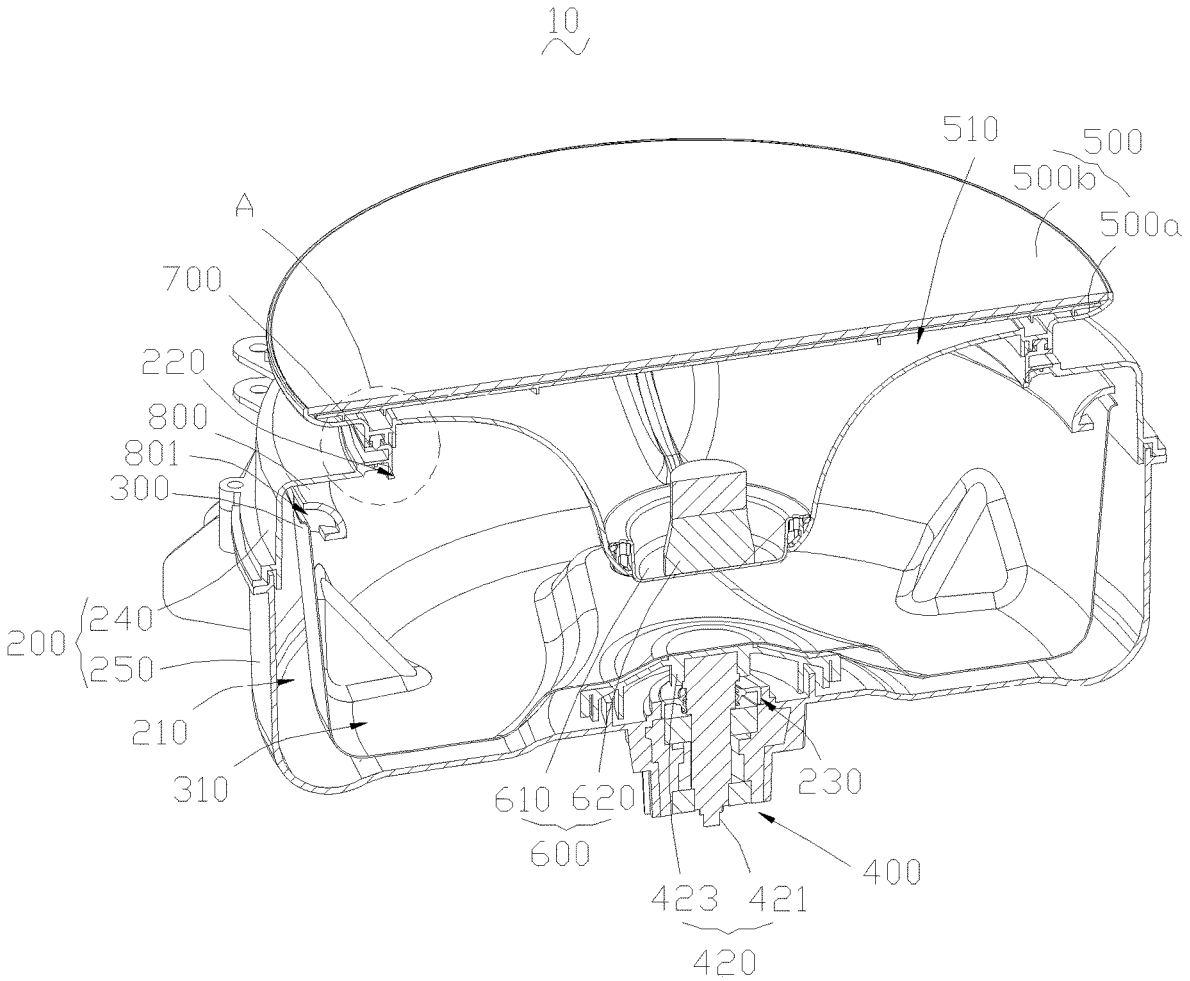
FIG. 4 is a perspective cross-sectional view of the washing machine assembly shown in FIG. 3.
Figure 5:
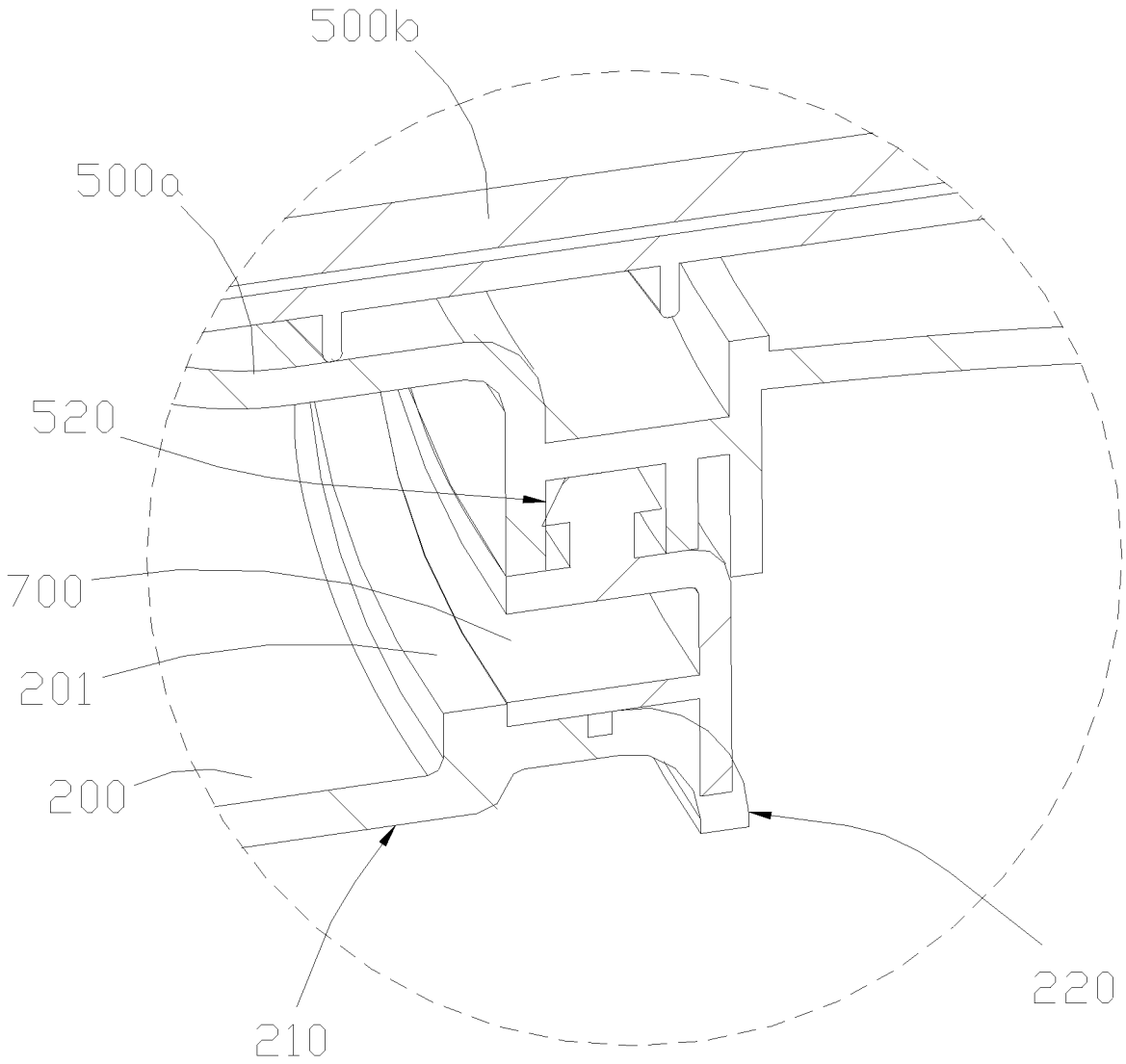
FIG. 5 is a partial enlarged view of a portion A of the washing machine assembly shown in FIG. 4.

As shown in FIGS. 3 to 5, in one of the embodiments, the outer drum is connected to the body. A receiving cavity 210 and an opening groove 220 in communication with the receiving cavity 210 are formed in the outer drum 200. The inner drum 300 is located in the receiving cavity 210, such that the inner drum is provided in the outer drum. A washing tank 310 is formed in the inner drum 300.

Referring to FIG. 4 again, in one of the embodiments, the door assembly 500 is rotatably connected to the outer drum 200, and the door assembly covers the outer drum to block the opening groove 220. A mounting hole 510 in communication with the washing tank 310 is formed in the door assembly 500. The door assembly covers the outer drum to block the opening groove 220 to ensure the sealing requirement in the outer drum, so as to prevent water in the inner drum from splashing to outside of the outer drum when the inner drum rotates with respective to the outer drum. The ultrasonic device 600 is provided in the mounting hole 510 of the door assembly and fixed at a bottom of the mounting hole 510. In this embodiment, the mounting hole extends from top to bottom and has a gradually narrowing diameter, such that the door assembly forms a truncated cone-like structure. The truncated cone-like structure is inverted, and has a concave and curved side surface. Further, the ultrasonic device is at least partially located in the washing tank 310, such that the ultrasonic device can be in contact with the water in the washing tank, such that the energy generated by the ultrasonic device will enable the water and clothes in the washing tank to vibrate at a high frequency to ensure ultrasonic waves can effectively act on detergent and clothes in the water, thereby achieving an effect of cleaning the clothes. In this embodiment, the inner drum has a cylindrical structure, and the washing tank is formed on an end surface of the inner drum adjacent to the door assembly. The washing tank is a circular tank structure with a predetermined depth. The ultrasonic device is partially located and suspended in the washing tank. That is, the ultrasonic device is located above a bottom of the washing tank. Specifically, the ultrasonic device is located in the washing tank at one half of the predetermined depth, such that the ultrasonic device can better act on the clothes and the detergent in the washing tank. Further, the ultrasonic device is located at a center of the washing tank, such that the ultrasonic device can uniformly act on the clothes and the detergent in the washing tank. Of course, in other embodiments, the ultrasonic device may also be located at a predetermined distance offset from the center of the washing tank.

Since the ultrasonic device is located in the mounting hole and connected to a door body, and the ultrasonic device is at least partially located in the washing tank, during use, the door assembly is firstly opened, and then the clothes as well as a proper amount of detergent are placed in the inner drum, and then the door assembly is closed, and the washing machine assembly starts the washing operation. The washing machine assembly will automatically fill water with a predetermined height into the inner drum, such that energy generated by the ultrasonic device will enable the water and clothes in the washing tank to vibrate at a high frequency to ensure that the ultrasonic device can be in contact with the water in the washing tank. Therefore, the energy generated by the ultrasonic device will vibrate the water and clothes in the washing tank at a high frequency to ensure that the ultrasonic waves can effectively act on the detergent and the clothes in the water, thereby achieving the effect of cleaning the clothes. If an amount of the water in the washing tank does not reach the predetermined height, the energy generated by the ultrasonic wave cannot be effectively transmitted, which will cause the energy generated by the ultrasonic device to be converted into heat, thereby causing the ultrasonic device to overheat and fail. The ultrasonic vibration generated by the ultrasonic device acts on the detergent to disperse and dissolve the detergent quickly, so as to ensure the maximum chemical effect of the detergent. Simultaneously, the ultrasonic vibration generated by the ultrasonic device acts on the clothes. In this way, for stains in the clothes, especially the harder stains, the high-frequency vibration of the ultrasonic device is used to vibrate and impact the stains on the surface of the clothes to dissolve the stains in the water flow, so as to separate the stains from the clothes, which greatly improves the cleanliness of rinsing and solves problems of poor washing effect of the clothes and greater waste of the detergent.

Since the door assembly covers the outer drum to block the opening groove, the door assembly is provided adjacent to the inner drum, and since the ultrasonic device is cleverly mounted on the door assembly, and the ultrasonic device is at least partially located in the washing tank, the ultrasonic waves generated by the ultrasonic device can directly and effectively act in the inner drum, thereby making full use of the ultrasonic excitation force, which solves the problem of poor cleaning effect of the washing machine assembly. Since the washing machine assembly mainly act on the clothes and the detergent through the effective ultrasonic waves, ways that the drum washing machine accelerates the chemical effect of the detergent by increasing the water temperature, and that the clothes are washed by mechanical friction are avoided, the problems of the damage to the clothing and a poor ease of use are prevented, and the problems of longer washing time and higher energy consumption are also solved.

In one of the embodiments, the above-mentioned washing machine assembly is a part of a washing machine. The washing machine is composed of two washing assemblies, i.e., an upper washing assembly and a lower washing assembly. The above-mentioned washing machine assembly is provided on the top and uses ultrasonic waves to cooperate with a rotation of an inner drum to wash clothes. A washing assembly having a size similar to a conventional drum washing machine are provide on the bottom. In one of the embodiments, a height of the above-mentioned washing machine assembly is less than half of that of a conventional pulsator washing machine. When the mount of clothes is small, a laundry by using the washing machine assembly on the top is more water-efficient. When there are more clothes, the washing assembly provided on the bottom can be used for washing.

Further, the washing machine assembly 10 further includes a driving mechanism 400. The outer drum 200 further forms a connecting hole 230 in communication with the receiving cavity 210. That is, the opening groove and the connecting hole are both in communication with the receiving cavity. The driving mechanism 400 extends through the connecting hole 230 and is rotatably connected to the outer drum. A power output end of the driving mechanism is connected to the inner drum, and the driving mechanism drives the inner drum to rotate with respect to the outer drum. Driving the inner drum to rotate with respect to the outer drum can rinse the clothes well. During the operating process of the ultrasonic device, the driving mechanism drives the inner drum to rotate with respect to the outer drum, such that the ultrasonic waves can evenly and effectively act at various positions of the clothes, while ensuring that the water in the inner drum has a certain flow rate, such that the stains fall into the water during the process of separating the stains from the clothes, thereby improving a laundry rate. When the laundry is finished, the inner drum rotates rapidly with respect to the outer drum, such that the water in the inner drum is discharged to the outer drum subjected to a centrifugal force, and then discharged to the outside of the washing machine assembly through the outer drum.

Further, the outer drum is movably connected to the body. When the drive mechanism drives the inner drum to rotate with respect to the outer drum, the outer drum moves with respect to the body, such that the outer drum can move with the rotation of the inner drum, preventing a problem of a large shaking of the body caused by a rigid connection between the outer drum and the body. Further, the washing machine assembly further includes a shock absorber. Two ends of the shock absorber are respectively connected to the outer drum and the body. The shock absorber plays a role of damping by friction, such that the outer drum is movably connected to the body, while ensuring that the vibration and the swing of the outer drum during washing and dehydration processes can be well buffered, so as to maintain a balance of the washing machine in a horizontal direction and reduce a vibration noise of the washing machine, thereby improving the service life and reliability of the washing machine. Further, a plurality of shock absorbers are provided. The plurality of shock absorbers are provided at intervals along a circumferential direction of the outer drum, which can well maintain the balance of the washing machine in the horizontal direction and reduce the vibration noise of the washing machine.

Figure 6:
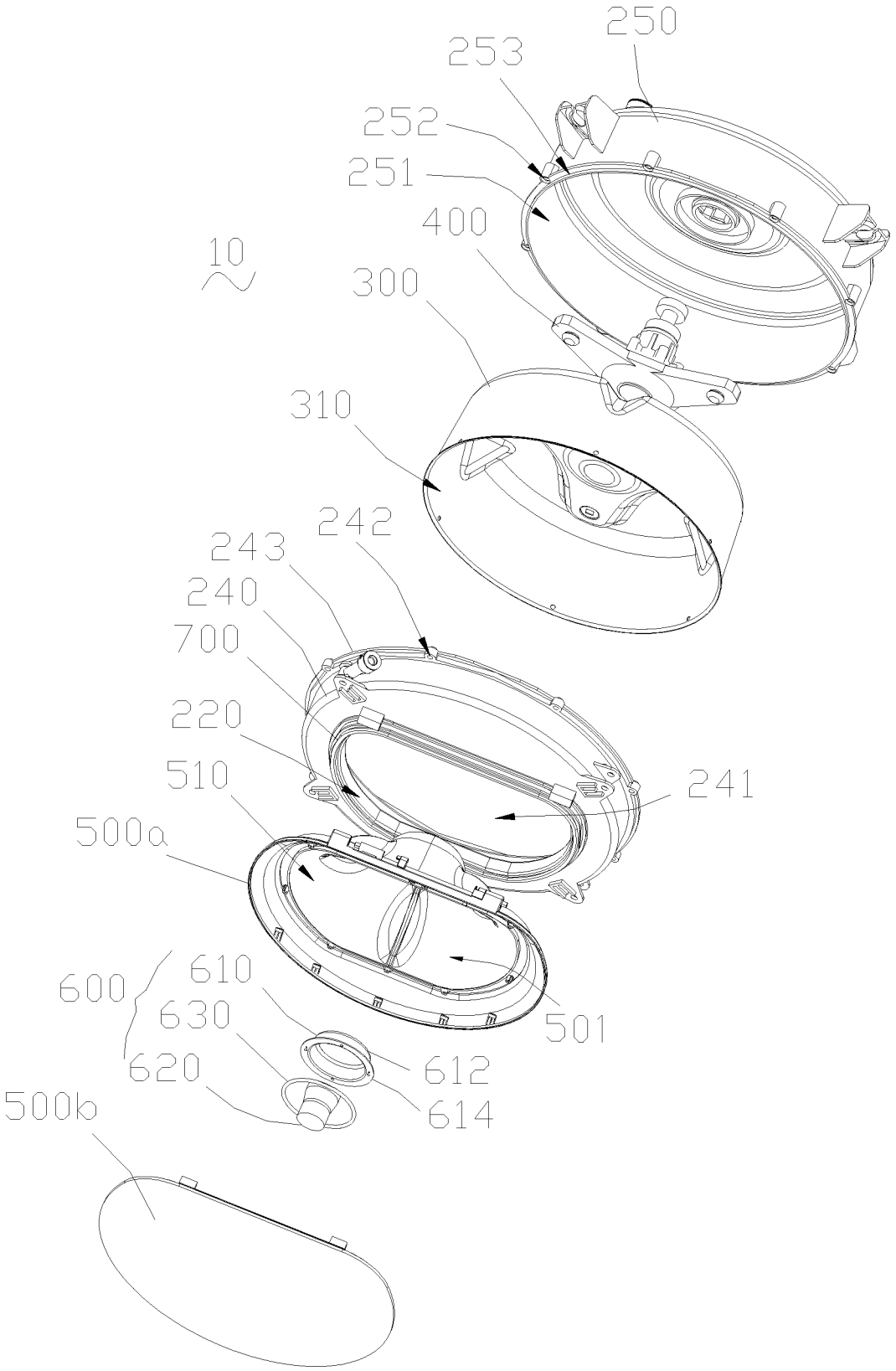
FIG. 6 is an exploded view of the washing machine assembly shown in FIG. 3.

As shown in FIG. 6, in one of the embodiments, the outer drum 200 includes a first cylinder 240 and a second cylinder 250 that are connected. The first cylinder 240 is provided with a first cavity 241. The second cylinder 250 is provided with a second cavity 251 in communication with the first cavity. Referring to FIG. 4, the first cavity and the second cavity cooperatively form the receiving cavity 210 of the outer drum. The opening groove 220 is provided on the first cylinder 240 and is in communication with the first cavity. The connecting hole 230 is provided on the second cylinder 250 and is in communication with the second cavity, such that a receiving cavity and the connecting hole are formed in the outer drum. In this embodiment, the first cylinder and the second cylinder are coaxially arranged, and the first cylinder is provided adjacent to the door assembly. The door assembly 500 is rotatably connected to the first cylinder 240, and the door assembly covers the first cylinder to block the opening groove. The driving mechanism is rotatably connected with the second cylinder. In this embodiment, the opening groove is provided on a side of the first cylinder away from the second cylinder. One side of the door assembly is rotatably connected to the side of the first cylinder away from the second cylinder, enabling the door assembly to be rotatably connected to the first cylinder well and cover the first cylinder.

As shown in FIG. 6, further, the outer drum includes a fastening screw. The first cylinder 240 is provided with a first screw hole 242. The second cylinder 250 is provided with a second screw hole 252. The fastening screw is respectively screwed to the first screw hole and the second screw hole, such that the first cylinder and the second cylinder are firmly connected. Further, a plurality of the fastening screw are provided, a plurality of the first screw hole and a plurality of the second screw hole are provided. The plurality of first screw holes are distributed at intervals along a circumferential direction of the first cylinder. The plurality of second screw holes are distributed at intervals along a circumferential direction of the second cylinder. Each fastening screw respectively extends through the corresponding first screw hole and the second screw hole, such that the first cylinder is tightly connected to the second cylinder. Further, an annular flange 243 is provided along the circumferential direction of the first cylinder 240, and an abutting groove 253 is opened along the circumferential direction of the second cylinder 250. The annular flange abuts against the abutting groove, such that the first cylinder is connected to the second cylinder more tightly.

As shown in FIGS. 4 and 6, in one of the embodiments, the ultrasonic device 600 includes an excitation plate 610 and a vibrator 620 provided on the excitation plate. The excitation plate is located in the mounting hole 510 and connected to the door assembly 500. The vibrator 620 is located in the mounting hole 510 to connect the ultrasonic device to the door body. The vibrator is connected in the door body in a sealed manner. The water in the inner drum is in contact with the excitation plate. Since the vibrator is connected in the door body in a sealed manner, the water in the inner drum will not enter the door body and damage the vibrator. When current is applied to the vibrator, the vibrator generates vibration and the vibration is transmitted to the excitation plate, such that the excitation plate is excited by the vibrator to generate ultrasonic vibration. In this way, the ultrasonic device generates the ultrasonic waves and the ultrasonic waves act on the clothes and the detergent. In this embodiment, the excitation plate is in contact with the water in the washing tank, such that heat generated during an operation of the vibrator is conducted to the water through the excitation plate for heat dissipation, so as to prevent the vibrator from overheating and failing.

Referring to FIG. 6 again, further, the excitation plate 610 includes an excitation plate main body 612 and a connecting flange 614 extending outwardly from a periphery of the excitation plate main body along a radial direction of the excitation plate main body. The vibrator 620 is provided on the excitation plate main body 612. The connecting flange is located in the mounting hole and connected to the door body, such that the excitation plate is located in the mounting hole and connected to the door body. Further, the ultrasonic device further includes a connecting screw. The connecting flange is provided with a through hole. The door body is provided with a fastening hole in communication with the mounting hole. The connecting screw extends through the through hole and the fastening hole, respectively, such that the connecting flange is firmly connected to the door body. Further, a cross-section of the excitation plate main body is U-shaped, such that the vibrator is well provided on the excitation plate main body. In this embodiment, the excitation plate main body and the connecting flange are integrally stamped and formed, such that the excitation plate has a compact structure. In other embodiments, the excitation plate main body and the connecting flange can also be formed separately and connected to each other by welding.

Figure 7:
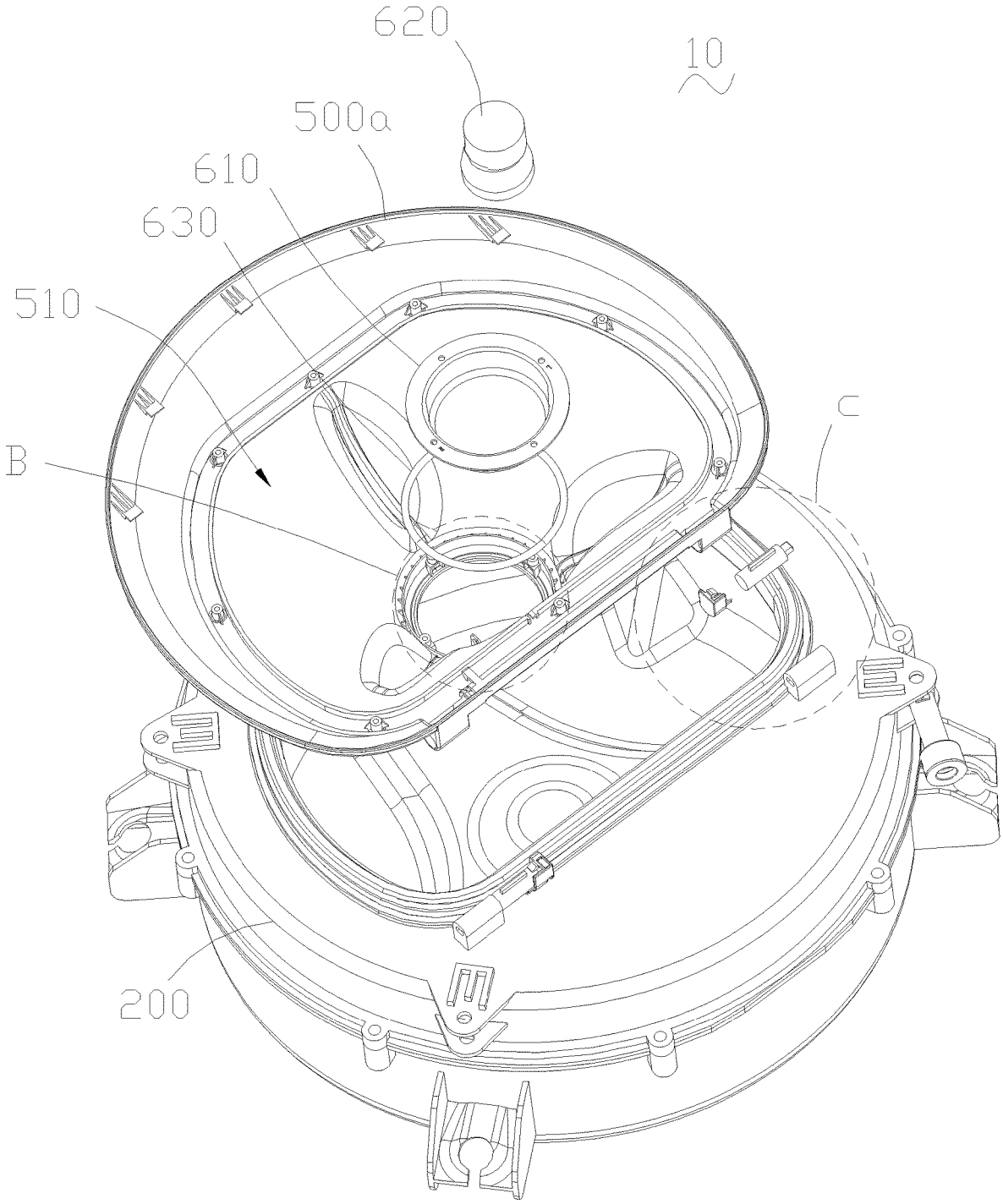
FIG. 7 is another exploded view of the washing machine assembly shown in FIG. 3.
Figure 8:
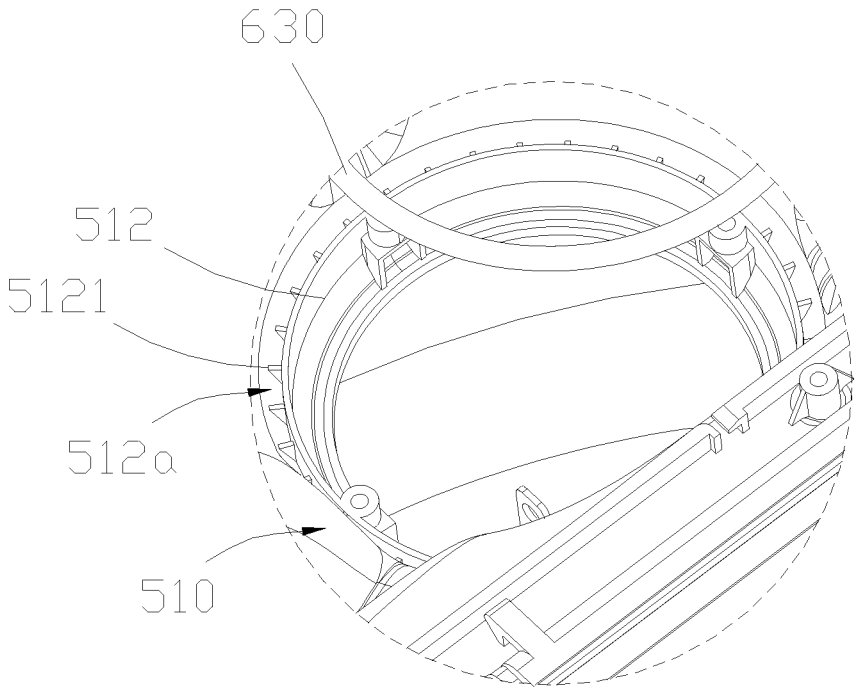
FIG. 8 is a partial enlarged view of a portion B of the washing machine assembly shown in FIG. 7.

As shown in FIGS. 7 and 8, in one of the embodiments, the door assembly 500 is provided with a positioning platform 512 on an inner wall of the mounting hole 510. The excitation plate 610 tightly abuts against the positioning platform, so as to prevent the water in the washing tank from entering the mounting hole through a gap between the excitation plate and the positioning platform, and prevent the ultrasonic device from being damaged. In this embodiment, the positioning platform is tightly connected to the connecting flange, such that the excitation plate is tightly connected to the positioning platform. The fastening hole is provided on the positioning platform.

As shown in FIGS. 7 and 8, in one of the embodiments, the ultrasonic device 600 further includes a sealing washer 630. The sealing washer respectively abuts against the excitation plate 610 and the positioning platform 512, such that the excitation plate is tightly connected to the positioning platform. In this embodiment, the sealing washer abuts against the connecting flange. As shown in FIG. 8, in one of the embodiments, the positioning platform 512 is provided with an annular groove 512*a*. The sealing washer 630 is located in the annular groove and abuts against the positioning platform to mount the sealing washer on the positioning platform more securely.

As shown in FIG. 8, in one of the embodiments, an inner wall of the annular groove 512*a* is provided with a plurality of positioning pieces 5121 that are spaced apart along an extending direction of the annular groove. The sealing washer elastically abuts against the plurality of positioning pieces, respectively. When the excitation plate is mounted on the positioning platform, the sealing washer is elastically deformed at a position where the sealing washer abuts against the positioning pieces, such that the sealing washer is well elastically abutted in the annular groove, and the sealing of a connection between the excitation plate and the positioning platform is further improved.

Figure 9:
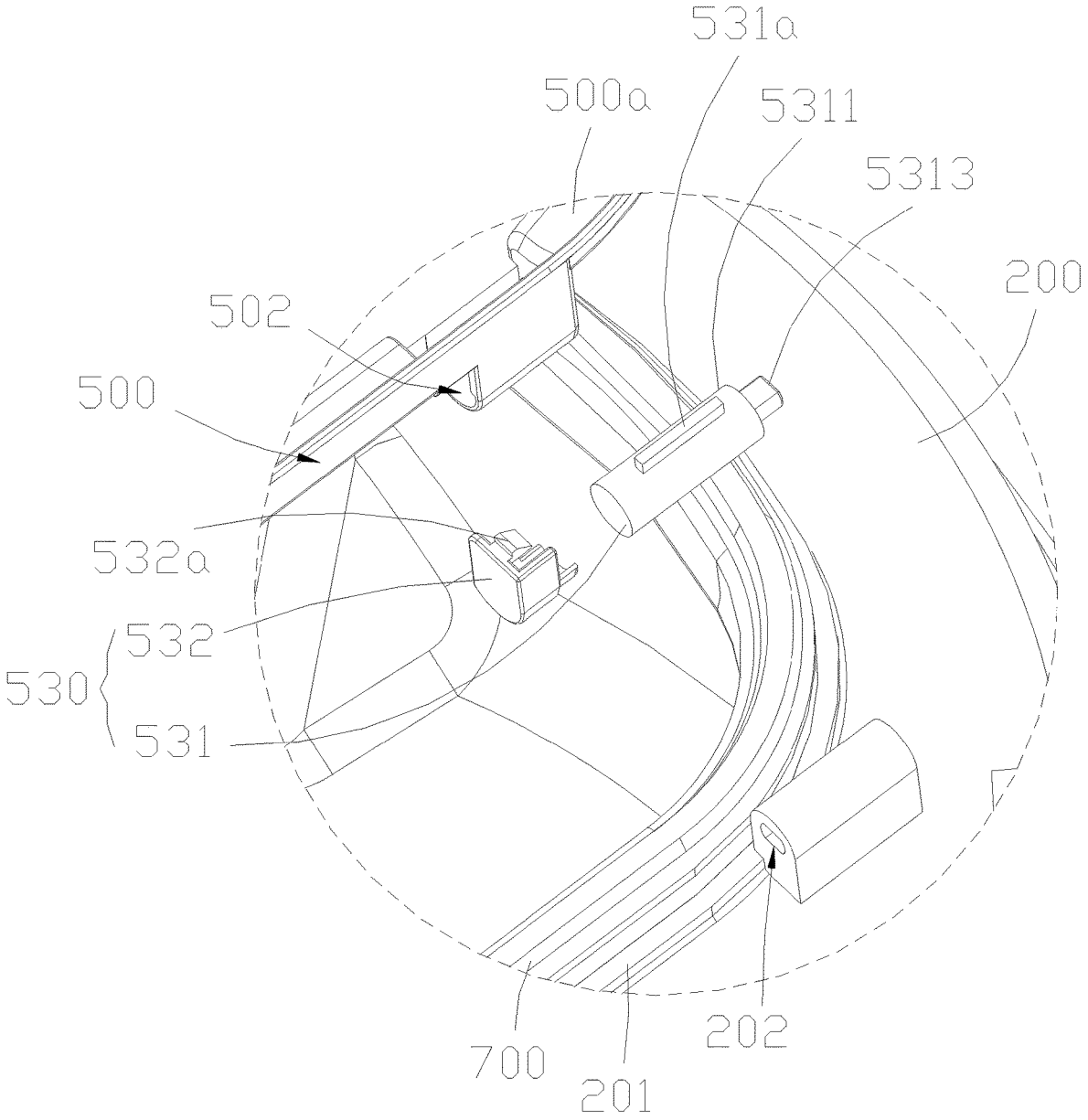
FIG. 9 is a partial enlarged view of a portion C of the washing machine assembly shown in FIG. 7.

As shown in FIGS. 7 and 9, in one of the embodiments, the washing machine assembly 10 further includes a sealing ring 700. A side of the door assembly 500 adjacent to the outer drum is provided with an engaging groove 520. The engaging groove surrounds the opening groove 220. The sealing ring is located in the engaging groove and abuts against the door assembly. The sealing ring further abuts against the outer drum 200 to seal the door assembly and the outer drum, such that the door assembly tightly covers the outer drum. In this embodiment, the sealing ring is made of rubber, which imparts an elastic to the sealing ring and ensures that the sealing ring elastically abuts against the door assembly. Specifically, in this embodiment, the sealing ring elastically abuts against the first cylinder, such that the sealing ring elastically abuts against the door assembly.

As shown in FIGS. 5 and 9, in one of the embodiments, the outer drum 200 is provided with an annular convex edge 201. The annular convex edge surrounds the opening groove 220. The annular convex edge surrounds the sealing ring 700 and abuts against the sealing ring, such that the sealing ring is reliably positioned on the outer drum by abutting. In this embodiment, the annular convex edge is provided on the first cylinder.

As shown in FIGS. 4 and 6, in one of the embodiments, the door assembly 500 includes a door body 500*a* and a cover body 500*b* covering the door body. The door body is rotatably connected to the outer drum 200. The door body covers the outer drum to block the opening groove. The mounting hole is formed in the door body, such that the door assembly is rotatably connected to the outer drum. The door assembly covers the outer drum to block the opening groove, and the door assembly is formed with a mounting hole. Further, the door body is at least partially located in the washing tank, such that the ultrasonic device can be completely located in the mounting hole to be in contact with the water in the washing tank, such that the ultrasonic device can conduct heat into the water.

As shown in FIG. 6, in one of the embodiments, the door body 500*a* is provided with a latching groove 501 in communication with the mounting hole 510. The cover body 500*b* is snapped into the latching groove, such that the door body is connected to the cover body by snapping. In other embodiments, the door body and the cover body are connected not limited to snapping, instead, the door body may also be connected to the cover body by glue, screws, or the like.

As shown in FIGS. 7 and 9, in one of the embodiments, the door assembly 500 further includes a rotating shaft 530. The rotating shaft is rotatably connected to the door body 500*a*. In addition, the rotating shaft is connected to the outer drum 200, such that the door body is rotatably connected to the outer drum. Specifically, the rotating shaft is connected to the first cylinder. In this embodiment, the rotating shaft is rotatably connected to the door body. In one of the embodiments, the door body 500*a* is provided with an inserting hole 502. The rotating shaft 530 extends through the inserting hole and is connected to the door body by snapping, such that the rotating shaft is connected to the door body. Further, the rotating shaft 530 includes a shaft body 531 and a latching member 532. The latching member is sleeved on the shaft body and is rotatably connected to the shaft body. The shaft body extends through the inserting hole 502 and is rotatably connected to the door body 500*a*. The latching member is snapped into the inserting hole, such that the rotating shaft is in a snapping connection with the door body. Further, a hook 532*a* protrudes from the latching member 532. The hook is snapped into the inserting hole, such that the latching member is snapped into the inserting hole. Further, an outer wall of the shaft body 531 is provided with a stop protrusion 531*a*. The stop protrusion is parallel to an axial direction of the shaft body. The stop protrusion is used to limit a rotation angle of the shaft body with respect to the latching member, such that the stop protrusion can only rotate within a predetermined angle range with respect to the latching member.

As shown in FIG. 9, in this embodiment, the rotating shaft is detachably connected to the outer drum. In one of the embodiments, the outer drum 200 is provided with a slot 202. The shaft body 531 is located in the slot and inserted into the outer drum, such that the rotating shaft is connected to the outer drum. Further, the shaft body 531 includes a shaft main body 5311 and an inserting shaft 5313 extending outward from an end of the shaft main body. The stop protrusion is provided on an outer wall of the shaft main body. The inserting shaft matches the slot, and the inserting shaft is inserted into the slot, such that the shaft body is inserted into the outer drum. In this embodiment, a cross-section of the inserting shaft 5313 is oblate, such that the shaft body will not rotate with respect to the outer drum at an inserting portion therebetween. In other embodiments, the cross-section of the inserting shaft can also be rectangular or elliptical.

Figure 10:
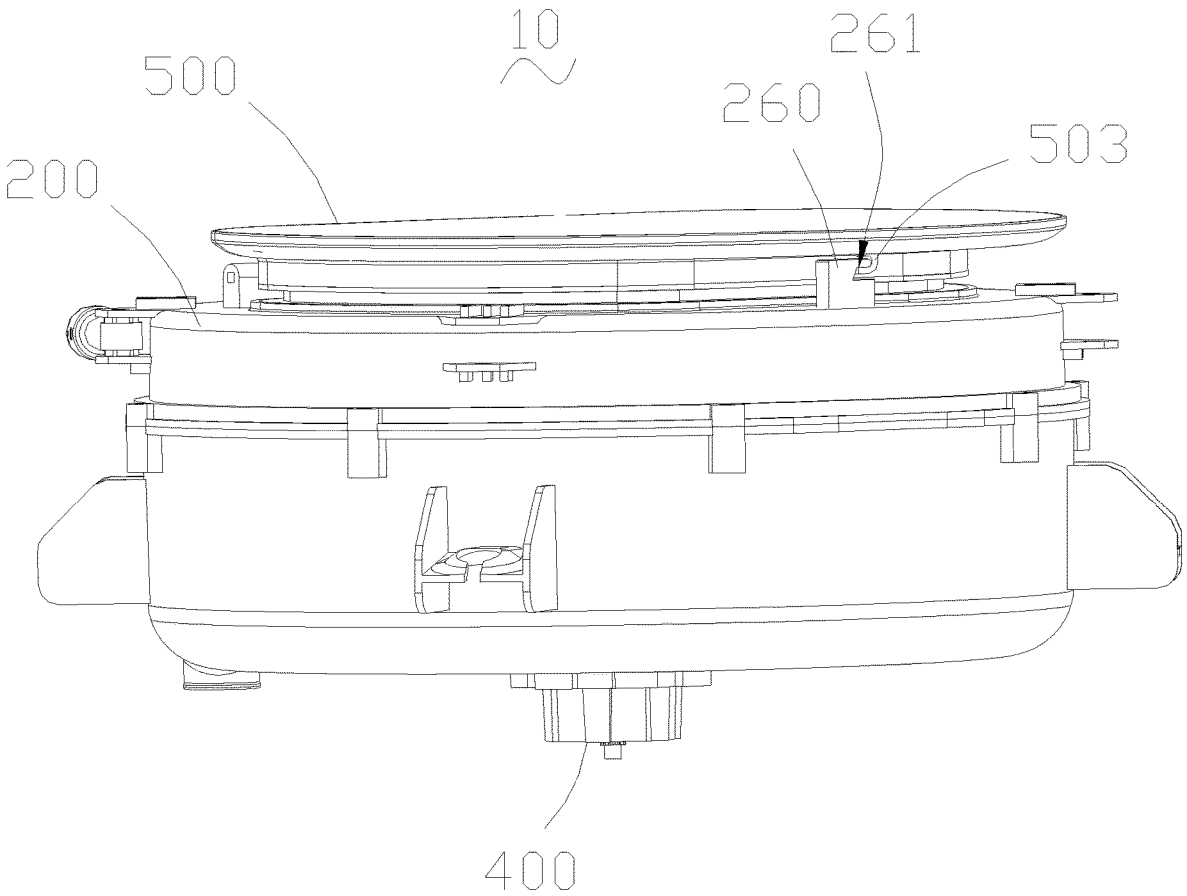
FIG. 10 is a schematic view of the washing machine assembly shown in FIG. 3 from another perspective.

As shown in FIG. 10, in one of the embodiments, the outer drum 200 is provided with a snapping block 260. The snapping block 260 is provided with a snapping groove 261. The door assembly 500 is provided with a latching hook 503. The latching hook is snapped into the snapping groove, such that the snapping block is connected to the latching hook by snapping, such that the door assembly reliably covers the outer drum. When the door assembly is required to be opened, the latching hook of the door assembly is firstly pulled to slide the latching hook out of the snapping groove, and then, the door assembly is rotated to a predetermined angle with respect to the outer drum to complete the opening operation of the door assembly. When the door assembly is required to be closed, the door assembly is firstly rotated to cover the outer drum, and then, the latching hook is snapped into the snapping groove to ensure that the door assembly reliably covers the outer drum. It should be understood that the door assembly and the outer drum are not limited to be fixed by a snapping connection. In other embodiments, the door assembly and the outer drum can also be fixed by a magnetic adsorption.

In one of the embodiments, the driving mechanism 400 further includes a driving assembly 410 and a connecting assembly 420. The driving assembly is located outside the outer drum 200. The connecting assembly 420 extends through the connecting hole 230 and is rotatably connected to the outer drum. The connecting assembly is connected to the inner drum. The connecting assembly is connected to the power output end of the driving assembly, such that the power output end of the driving mechanism drives the connecting assembly to rotate. Since the connecting assembly is rotatably connected to the outer drum, and the connecting assembly is connected to the inner drum, the connecting assembly drives the inner drum to rotate with respect to the outer drum. In this embodiment, the driving assembly is a motor assembly.

Figure 11:
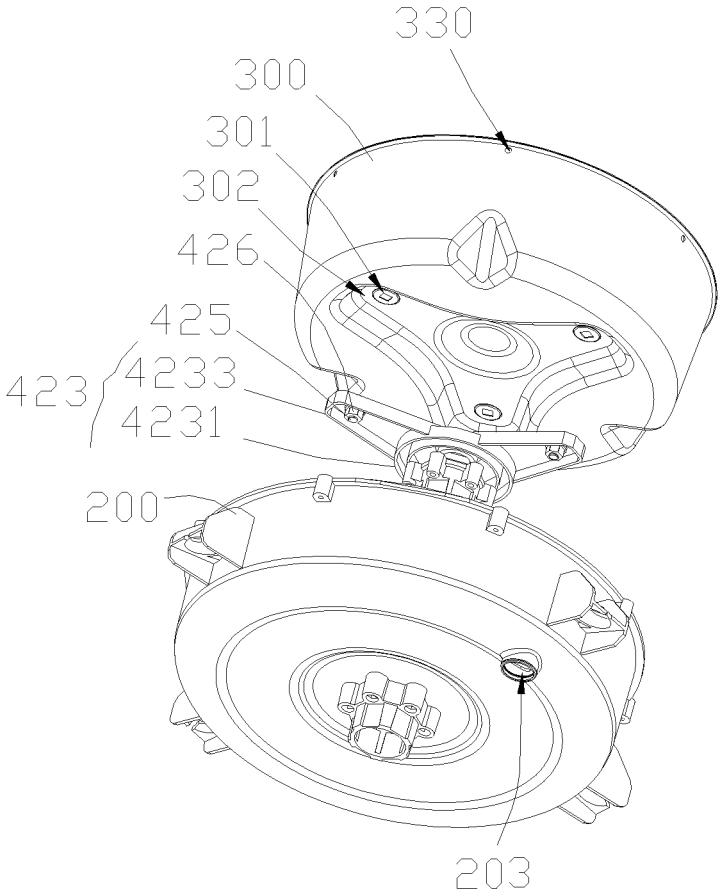
FIG. 11 is a partial exploded view of the washing machine assembly shown in FIG. 3.

As shown in FIG. 4, further, the connecting assembly 420 includes a transmission shaft 421 and a rotating frame 423. One end of the transmission shaft is connected to the power output end of the driving assembly 410, and the other end of the transmission shaft is connected to the rotating frame. The rotating frame 423 is connected to the inner drum 300 such that the connecting assembly is connected to the inner drum. The driving assembly drives the transmission shaft to rotate, and the transmission shaft simultaneously drives the rotating frame to rotate. The transmission shaft extends through the connecting hole and is rotatably connected to the outer drum, such that the connecting assembly extends through the connecting hole and is rotatably connected to the outer drum. Referring to FIG. 11, further, the connecting assembly 420 further includes a fixing screw 425 and a fixing nut 426. A threaded hole is provided on the rotating frame. A fixing hole 301 in communication with the washing tank is provided on the inner drum 300. The fixing screw respectively extends through the threaded hole and the fixing hole. The fixing nut is sleeved on the fixing screw, and the fixing nut abuts against a side of the rotating frame away from the inner drum, such that the inner drum is fixedly connected to the rotating frame. Further, the connecting assembly further includes a sealing gasket, which is sleeved on the fixing screw. The sealing gasket respectively abuts against the rotating frame and the inner drum, such that the rotating frame is tightly connected to the inner drum. Further, the inner drum 300 is provided with a positioning groove 302 in communication with the fixing hole. The rotating frame is located in the positioning groove and abuts against the inner drum, such that the rotating frame is well fixedly connected to the inner drum.

As shown in FIG. 11, further, the rotating frame 423 includes a rotating frame main body 4231 and an extending portion 4233 protruding from the rotating frame main body. The rotating frame main body is connected to the transmission shaft. The threaded hole is provided on the extending portion, such that the rotating frame is provided with the threaded hole. Further, a plurality of fixing screws, fixing nuts, and extending portions are provided, and the plurality of extending portions are distributed at intervals along a circumferential direction of the rotating frame main body. Each extending portion is provided with the threaded hole. A plurality of fixing holes are provided on the inner drum. Each fixing screw extends through the corresponding threaded hole and fixing hole, such that the rotating frame is firmly connected to the inner drum. In this embodiment, three fixing screws, three fixing nuts, and three extending portions are provided.

In order to achieve a better rotating connection between the transmission shaft and the outer drum, further, the connecting assembly further includes a bearing. An inner ring of the bearing is sleeved on the transmission shaft, and an outer ring of the bearing is located in the connecting hole and connected to the outer drum, such that the connecting assembly is well rotatably connected to the transmission shaft.

During a washing process, the driving assembly drives the transmission shaft to rotate, and the transmission shaft drives the inner drum to rotate with respect to the outer drum through the rotating frame. During the washing process, the washing tank of the inner drum is used to receive the water and the clothes, and the water in the inner drum will not enter the outer drum. When the washing is finished, the water in the inner drum is discharged into the outer drum, and then discharged from the outer drum to the outside of the washing machine assembly. Specifically, a rotation speed of the inner drum with respect to the outer drum reaches a predetermined value, and the water in the inner drum is separated from the clothes subjected to the centrifugal force and is dried out to the outer drum.

Figure 12:
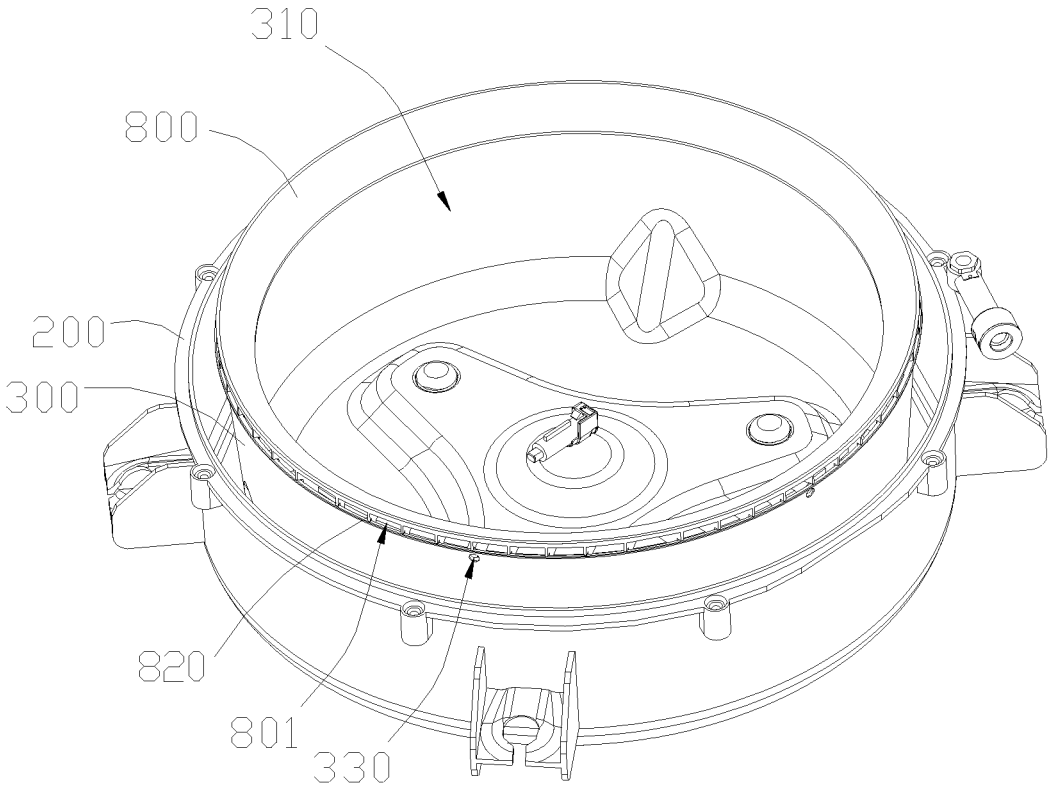
FIG. 12 is a partial schematic view of the washing machine assembly shown in FIG. 3.
Figure 13:
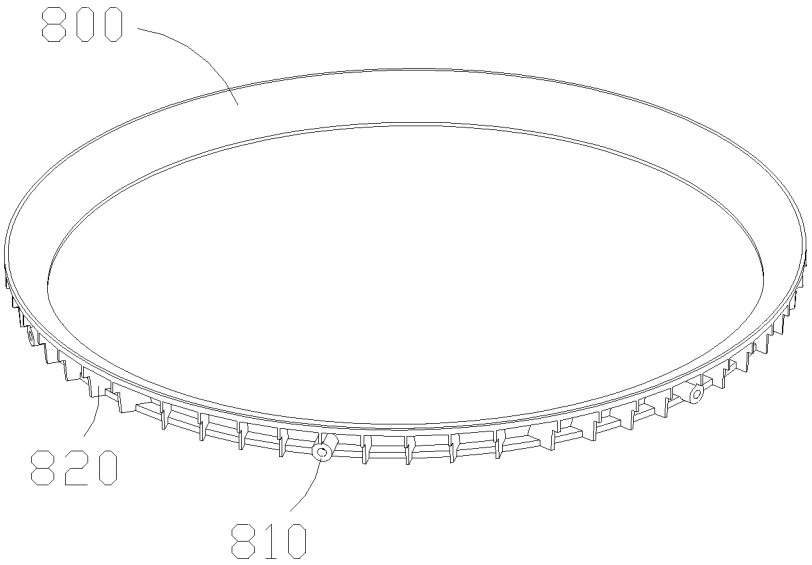
FIG. 13 is a schematic view of an exhaust ring of the washing machine assembly shown in FIG. 12.

In order to prevent the water in the washing tank from being dried out of the inner drum accidentally during the washing process, further, as shown in FIG. 11, a side wall of the inner drum 300 is provided with a first mounting hole 330 in communication with the washing tank 310, such that the water in the washing tank is quickly discharged out of the inner drum through the first mounting hole. As shown in FIGS. 12 and 13, the washing machine assembly 10 further includes an exhausting ring 800, which is located in the washing tank 310 and is rotatably connected to the inner drum 300. There is a gap 801 in communication with a first mounting hole between the exhausting ring and the inner drum. Abutments 810 are provided on a peripheral wall of the exhausting ring 800. The abutment corresponds to the first mounting hole 330, such that a fastener is connected to the abutment through the first mounting hole, and such that the exhausting ring is fixed on the inner drum. Further, the washing machine assembly 10 further includes a mounting screw. The first mounting hole is a threaded hole, and the mounting screw is connected to the exhausting ring through the first mounting hole to ensure that the exhausting ring is well fixed on the inner drum. Specifically, a plurality of abutting protrusions 820 are provided on a peripheral wall of the exhausting ring 800 at intervals to ensure that the gap 801 is formed between the exhausting ring and the inner drum. Further, a plurality of abutments are uniformly spaced along a circumferential direction of the exhausting ring, such that the gap 801 is uniformly formed between the exhausting ring and the inner drum, ensuring that the water in the washing tank can be quickly and effectively dried out, improving the exhausting efficiency of the inner drum.

Referring to FIG. 11 again, in order to discharge the water in the outer drum to the outside of the washing machine assembly, in one of the embodiments, the washing machine assembly further includes a drain pipe (not shown). The outer drum 200 is provided with a drain hole 203 in communication with the receiving cavity 210. An end of the drain pipe is in communication with the drain hole, such that the water in the outer drum is discharged to the outside of the washing machine assembly through the drain pipe.

In order to prevent part of the water from overflowing to the bearing through the connecting hole during the discharging process of the outer drum, further, the connecting assembly further includes a bearing sealing member. The bearing sealing member is sleeved on the transmission shaft, and the bearing sealing member is provided in the connecting hole, so as to seal the bear, while preventing part of the water from overflowing to the bearing through the connecting hole during the discharging process of the outer drum.

The technical features of the above-mentioned embodiments can be combined arbitrarily. In order to simply the description, all possible combinations of the technical features in the above-mentioned embodiments are not described. However, as long as there is no contradiction in the combinations of these technical features, they should be considered to be fallen into the range described in the present specification.

Only several implementations of the present application are illustrated in the above-mentioned embodiments, and the description thereof is relatively specific and detailed, but it should not be understood as a limitation on the scope of the present application. It should be noted that for those of ordinary skill in the art, without departing from the concept of the present application, several modifications and improvements can be made, which all fall within the protection scope of the present application. Therefore, the protection scope of the present application shall be subject to the appended claims.

What is claimed is:

1. A washing machine assembly, comprising:

a body;

an outer drum connected to the body, the outer drum forming a receiving cavity and an opening groove in communication with the receiving cavity therein;

an inner drum located in the receiving cavity, the inner drum forming a washing tank;

a door assembly rotatably connected to the outer drum, the door assembly covering the outer drum to block the opening groove, and the door assembly forming a mounting hole therein; and an ultrasonic device located in the mounting hole and connected to the door assembly, and the ultrasonic device being at least partially located in the washing tank; and wherein the ultrasonic device comprises an excitation plate and a vibrator provided on the excitation plate, the excitation plate is located in the mounting hole and connected to the door assembly, the vibrator is located in the mounting hole, the excitation plate comprises an excitation plate main body and a connecting flange extending outwardly from a periphery of the excitation plate main body along a radial direction of the excitation plate main body, the vibrator is provided on the excitation plate main body, and the connecting flange is located in the mounting hole and connected to the door body.

2. The washing machine assembly according to claim 1, wherein the ultrasonic device further comprises a connecting screw, the connecting flange is provided with a through hole, the door body is provided with a fastening hole in communication with the mounting hole, and the connecting screw extends through the through hole and the fastening hole, respectively.

3. The washing machine assembly according to claim 1, further comprising a sealing ring, wherein a side of the door assembly adjacent to the outer drum is provided with an engaging groove, the engaging groove surrounds the opening groove, the sealing ring is located in the engaging groove and abuts against the door assembly, the sealing ring further abuts against the outer drum.

4. The washing machine assembly according to claim 3, wherein outer drum is provided with an annular convex edge surrounding the opening groove, and the annular convex edge surrounds the sealing ring and abuts against the sealing ring.

5. The washing machine assembly according to claim 1, further comprising a sealing ring, wherein a side of the door assembly adjacent to the outer drum is provided with an engaging groove, the engaging groove surrounds the opening groove, the sealing ring is located in the engaging groove and abuts against the door assembly, the sealing ring further abuts against the outer drum.

6. The washing machine assembly according to claim 5, wherein the outer drum is provided with an annular convex edge surrounding the opening groove, and the annular convex edge surrounds the sealing ring and abuts against the sealing ring.

7. The washing machine assembly according to claim 1, wherein the door assembly comprises a door body and a cover body covering the door body, the door body is rotatably connected to the outer drum, the door body covers on the outer drum to block the opening groove, and the mounting hole is formed in the door body.

8. The washing machine assembly according to claim 7, wherein the door body is provided with a latching groove in communication with the mounting hole, and the cover body is snapped into the latching groove.

9. The washing machine assembly according to claim 7, wherein the door assembly further comprises a rotating shaft rotatably connected to the door body, and the rotating shaft is connected to the outer drum.

10. The washing machine assembly according to claim 9, wherein the door body is provided with an inserting hole, the rotating shaft extends through the inserting hole and is connected to the door body by snapping.

11. The washing machine assembly according to claim 1, further comprising a driving mechanism, wherein the outer drum further forms a connecting hole in communication with the receiving cavity, the driving mechanism extends through the connecting hole and is rotatably connected to the outer drum, a power output end of the driving mechanism is connected to the inner drum, and the driving mechanism drives the inner drum to rotate with respect to the outer drum.

12. The washing machine assembly according to claim 11, wherein the driving mechanism further comprises a driving assembly located outside the outer drum and a connecting assembly extending through the connecting hole and rotatably connected to the outer drum, the connecting assembly is connected to the inner drum, and the connecting assembly is connected to the power output end of the driving assembly.

13. The washing machine assembly according to claim 12, wherein the connecting assembly comprises a transmission shaft and a rotating frame, one end of the transmission shaft is connected to the power output end of the driving assembly, and the other end of the transmission shaft is connected to the rotating frame, and the rotating frame is connected to the inner drum.

14. A washing machine assembly, comprising:

a body;

an outer drum connected to the body, the outer drum forming a receiving cavity and an opening groove in communication with the receiving cavity therein;

an inner drum located in the receiving cavity, the inner drum forming a washing tank;

a door assembly rotatably connected to the outer drum, the door assembly covering the outer drum to block the opening groove, and the door assembly forming a mounting hole therein; and an ultrasonic device located in the mounting hole and connected to the door assembly, and the ultrasonic device being at least partially located in the washing tank; and wherein the ultrasonic device comprises an excitation plate and a vibrator provided on the excitation plate, the excitation plate is located in the mounting hole and connected to the door assembly, the vibrator is located in the mounting hole, the door assembly is provided with a positioning platform on an inner wall of the mounting hole, the excitation plate abuts against the positioning platform, the ultrasonic device further comprises a sealing washer, and the sealing washer respectively abuts against the excitation plate and the positioning platform, such that the excitation plate is connected to the positioning platform.

15. The washing machine assembly according to claim 14, wherein the positioning platform is provided with an annular groove, and the sealing washer is located in the annular groove and abuts against the positioning platform.

16. The washing machine assembly according to claim 15, wherein an inner wall of the annular groove is provided with a plurality of positioning pieces that are spaced apart along an extending direction of the annular groove, and the sealing washer elastically abuts against the plurality of positioning pieces, respectively.

17. A washing machine assembly, comprising:

a body;

an outer drum connected to the body, the outer drum forming a receiving cavity and an opening groove in communication with the receiving cavity therein;

an inner drum located in the receiving cavity, the inner drum forming a washing tank;

a door assembly rotatably connected to the outer drum, the door assembly covering the outer drum to block the opening groove, and the door assembly forming a mounting hole therein; and an ultrasonic device located in the mounting hole and connected to the door assembly, the ultrasonic device being at least partially located in the washing tank; and wherein the outer drum is provided with a snapping block, the snapping block is provided with a snapping groove, the door assembly is provided with a latching hook snapped into the snapping groove.

* * * * *